United States Patent [19]

Crago

[11] 4,264,282

[45] Apr. 28, 1981

[54] AIR COMPRESSOR APPARATUS INCLUDING NOISE-REDUCING MEANS

[75] Inventor: William T. Crago, Carmel, Ind.

[73] Assignee: K. C. Mosier Company, Dayton, Ohio

[21] Appl. No.: 703

[22] Filed: Jan. 3, 1979

[51] Int. Cl.[3] ..... F04B 39/06

[52] U.S. Cl. ..... 417/243; 181/202; 417/12; 417/28; 417/38; 417/290; 417/307; 417/312; 417/363; 4217/368; 417/426

[58] Field of Search ..... 417/312, 313, 363, 307, 417/542, 279, 366, 368, 36, 38, 12, 316, 243, 234, 290, 426; 181/200, 202, 204, 207, 208, 224, 225

[56] References Cited

U.S. PATENT DOCUMENTS

| | | | |
|---|---|---|---|
| 1,187,031 | 6/1916 | Black et al. | 417/368 X |
| 1,320,224 | 10/1919 | Garman | 417/312 |
| 1,610,774 | 12/1926 | Hanson | 417/312 |
| 1,694,218 | 12/1928 | Hazard | 417/243 |
| 3,478,958 | 11/1969 | Hinck et al. | 417/312 X |
| 3,480,201 | 11/1969 | Whiting | 417/243 |
| 3,789,954 | 2/1974 | Raleigh | 417/312 X |
| 3,799,703 | 3/1974 | Paine et al. | 417/312 |
| 3,930,558 | 1/1976 | Schnell et al. | 181/200 |
| 3,989,415 | 11/1976 | Van-Hee et al. | 417/312 |

FOREIGN PATENT DOCUMENTS

| | | | |
|---|---|---|---|
| 1577688 | 8/1969 | France | 181/202 |
| 357147 | 9/1931 | United Kingdom | 181/202 |

*Primary Examiner*—Carlton R. Croyle
*Assistant Examiner*—Edward Look
*Attorney, Agent, or Firm*—Woodard, Weikart, Emhardt & Naughton

[57] ABSTRACT

An air compressor apparatus including noise-reducing means for converting ambient air into compressed air includes an air compressor surrounded by a noise-reducing enclosure and a plurality of shock-absorbing means disposed between the air compressor and the enclosure. The enclosure includes a pair of interior baffle plates which divide the interior of the enclosure into an air inlet chamber, an air outlet chamber and an air compressor chamber therebetween. The air inlet chamber and the air outlet chamber are each open to the atmosphere at a first lower end and are each in communication with the air compressor chamber at a second opposite upper end. The enclosure further includes a fan positioned within the baffle plate between the air compressor chamber and the air outlet chamber which is operable to draw air in through the open end of the air inlet chamber across the air compressor chamber and out the air outlet chamber. The air inlet chamber and air outlet chamber are each lined with acoustical foam in order to absorb sound waves originating with the air compressor and passing through these chambers.

11 Claims, 6 Drawing Figures

AIR COMPRESSOR APPARATUS INCLUDING NOISE-REDUCING MEANS

BACKGROUND OF THE INVENTION

This invention relates in general to air compressors and in particular to air compressor apparata including noise-reducing means.

Air compressor apparata and related equipment are currently manufactured in a wide range of styles and capacities. Air compressors may be either oil-less or lubricated and operate on the theory of intaking ambient air and transforming this ambient air into compressed air which may then either be stored in a reservoir tank or delivered directly to a remote use location. Compressed air has a variety of uses such as for operating small hand tools and for medical and dental equipment. Air compressors may be either a rotary-vane style or a piston style and the requirements of the related equipment with which the air compressor is used govern what horsepower size unit is most appropriate.

In certain applications, it is quite important that the supplied compressed air be oil-free as well as dry. Consequently, an oil-less air compressor must be selected and coupled to a refrigerant dryer or similar device in order to remove a majority of the moisture which is commonly found within ambient air. Although the variety of compressors seems somewhat endless, all compressors are alike in that their operation generates a noticeable amount of heat as well as noise. While many compressors incorporate blowers and finned heat sinks to reduce the effect of the elevated temperatures generated, very little has been done to combat the level of noise which is also generated. While noise is not directly harmful in most situations, it is quite undesirable in virtually every medical and dental application due to its distracting and annoying aspects.

In an effort to try and muffle or reduce noise, a variety of compressor enclosures have been conceived. The following five patent references disclose certain ones of these enclosure concepts:

| Patent No. | Patentee | Issue Date |
|---|---|---|
| 2,928,589 | Davey | 3/15/60 |
| 3,698,840 | Hover | 10/17/72 |
| 3,905,204 | Edwards | 9/16/75 |
| 2,721,028 | Dills | 10/18/55 |
| 3,612,213 | Piko | 10/12/71 |

Davey discloses a hermetically sealed motor compressor unit including noise-reducing means. The noise of concern is the result of vibrations and is collectively referred to as "cavity resonance." This noise is decreased by providing between the outer casing and the compressor unit a curtain of woven cloth.

Hover discloses a compressor muffler construction for a gas pump which has an improved dampening capability for pressure pulses induced by the pump to provide a reduced noise level with less flow restriction losses.

Edwards discloses an auxiliary porting arrangement for noise control of an air-conditioning compressor-expander. The compressor inlet port and expander outlet port are so positioned that the volume of an exiting charge of air is less than the volume of an entering charge of air in a predetermined ratio so that air is discharged at nominally ambient pressure.

Dills discloses an arrangement for reducing the case resonance of a high-speed compressor to a lower level where it is not objectionable and for reducing the driven noise that comes through the compressor casing. The arrangement includes a series of shock absorbers disposed adjacent the exterior of the compressor casing and held in position by a strap.

Piko discloses a silent housing for air pumps and compressors which is fabricated of sound-deadening material and includes a pair of air intake resonant valves tunable to an upper frequency of the pump or compressor. The housing further includes a pair of outlet valves tuned to the same frequency as the intake valves.

Although the disclosed concepts of these various patent references may have provided some innovation at the time of their conception, each of these devices have the same two disadvantages. First, the primary manner of noise reduction is by reducing vibration and case resonance and nothing is done to dampen or reduce the internal noise generated by the operation of the compressor. Secondly, with each arrangement which encloses the compressor, sufficient cooling means are not provided in order to reduce the heat buildup within the enclosure and thus enable the compressor to continue to operate within a safe ambient temperature range. Although enclosing the compressor may reduce noise, it also traps all generated heat which quickly creates an interior temperature which can adversely affect the compressor and its operation. Thus, it would be an improvement to such compressor arrangements to provide a soundproofing enclosure with a suitable air circulation construction to enable noise reduction as well as maintenance of a safe interior temperature.

SUMMARY OF THE INVENTION

An air compressor apparatus including noise-reducing means for converting ambient air into dry, compressed air according to one embodiment of the present invention comprises an air compressor having an inlet for ambient air and an outlet for compressed air and a noise-reducing enclosure surrounding the air compressor and including an air compressor chamber, an air inlet chamber open to the atmosphere at one end and in communication with the air compressor chamber adjacent the opposite end and an air outlet chamber open to the atmosphere at one end and in communication with the air compressor chamber adjacent the opposite end, the inlet chamber and outlet chamber being an opposite sides of the air compressor chamber.

One object of the present invention is to provide an improved air compressor apparatus with noise-reducing means.

Related objects and advantages of the present invention will be apparent from the following description.

DESCRIPTION OF THE PREFERRED EMBODIMENT

Figure 1:
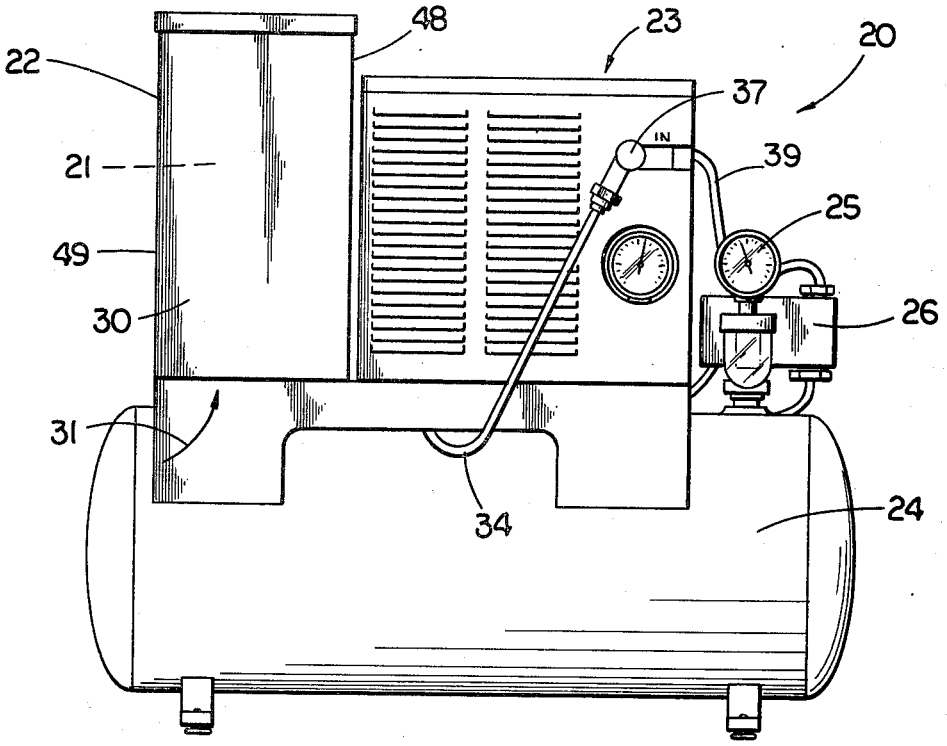
FIG. 1 is a front elevation view of an air compressor apparatus according to a typical embodiment of the present invention.
Figure 2:
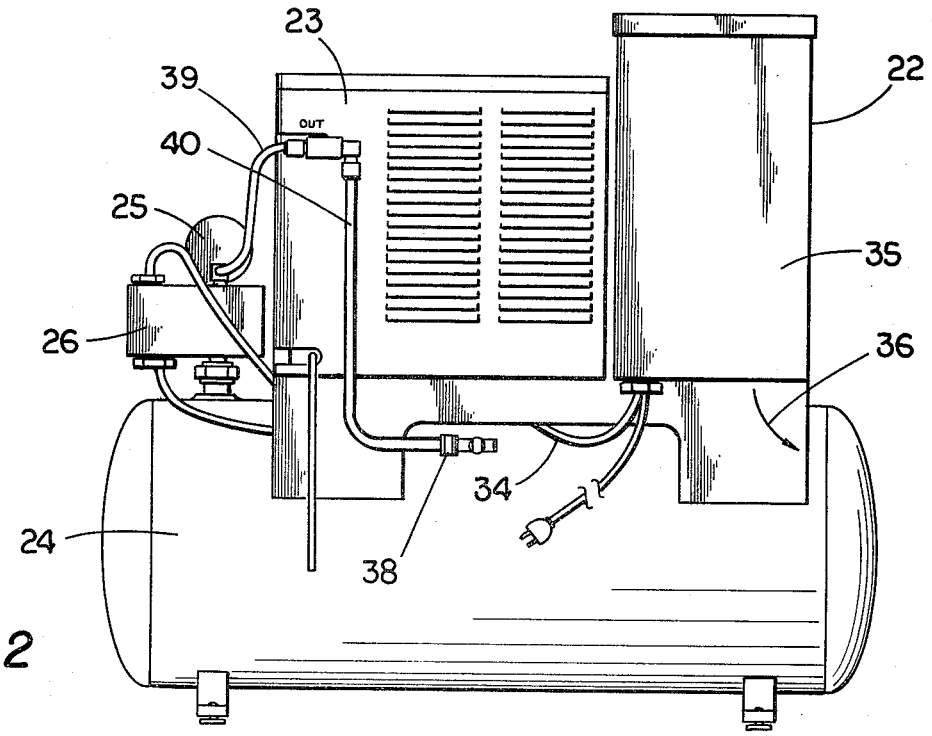
FIG. 2 is a rear elevation view of the FIG. 1 air compressor apparatus.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated an air compressor apparatus 20 for providing dry, oil-free compressed air and which includes an air compressor 21 (hidden from view in FIG. 1), noise-reducing enclosure 22, refrigerant dryer 23 and reservoir tank 24. Compressor 21, dryer 23 and tank 24 are arranged relative to each other and in combination with gauge 25, pressure switch 26 and related tubing and fittings so as to function in the following manner. By means of a fan 29 positioned within enclosure 22 (see FIGS. 3 and 4), ambient air is drawn into enclosure 22 from beneath and at one end 30 as illustrated by arrow 31. This incoming ambient air is drawn into the interior of enclosure 22 and flows across the exterior of air compressor 21. A portion of this incoming air is drawn into compressor 21 through air filter 32 and provides the supply air for the compressor. Once this air is compressed, it exits through outlet fitting 33 and outlet tube 34. Since the opposite end 35 of enclosure 22 is also open at its lowermost edge, an air escape path from fan 29 is provided at this location as illustrated by arrow 36. This opening region provides clearance access for outlet tube 34 to exit from enclosure 22 in order to make its requisite connection to the inlet port 37 of refrigerant dryer 23. Although there are a variety of refrigerant dryers, a typical dryer suitable for use herein may include an air-to-air heater exchanger where the incoming compressed air is precooled. Next, there is an air-to-air refrigerant heat exchanger where the temperature of this air is further reduced by the cold refrigerant causing water vapor to condense. This condensate is caught in a separator and then expelled by the unit's automatic drain system resulting in dry, cool air. In the event the particular refrigerant dryer selected includes an air-to-air heat exchanger, this dry, cool air passes back through the air-to-air heat exchanger and is reheated by the incoming air. If such an air-to-air heat exchanger is not present, this dry cool air passes directly to a downstream location such as tank 24. Regardless of the style of refrigerant dryer employed, the dry, oil-free, compressed air leaves refrigerant dryer 23 by means of supply tube 40 and passes into reservoir tank 24.

When there is a demand for compressed air, a portion of the contained volume within reservoir tank 24 is withdrawn thereby decreasing the internal pressure of tank 24. By means of a suitable arrangement of a pressure switch 26 and the necessary tubing and fittings, the air compressor 21 is energized in order to provide additional dry, compressed air for refilling of tank 24. Once tank 24 is filled, the pressure switch 26 deengerizes the air compressor and by a suitable arrangement of tubing and check valves, the pressure in the lines downstream from the air compressor is allowed to bleed off to the atmosphere. A suitable air compressor for this particular application is an 807 series piston compressor offered by the Power Air Division of Thomas Industries, Inc. of Sheboygan, Wisconsin. There are also further models within this general design category which are also acceptable such as a 707 series, a 1007 series and an 1107 series, and the choice depends upon the particular horsepower size and pressure versus volume flow rate relationships desired. A suitable refrigerant dryer for the described apparatus is offered by the C. A. Norgren Co. of Littleton, Colorado, and the specific model selected is dependent upon the desired scfm rate.

One aspect of many air compressors is that initial start-up of the compressor requires a near-zero back pressure in the downstream line. Therefore, there is a need to unload the pressure in the downstream line which is trapped between check valve 38 and the compressor in order to be able to restart the compressor. One method of unloading the trapped air pressure is to provide as part of pressure switch 26 an integral unloading mechanism such that once the pressure switch deenergizes the air compressor, an escape path to the atmosphere is provided for the trapped air. Line 39 provides the escape path via the unloading mechanism within pressure switch 26. If a conventional pressure switch is used which does not include such an integral unloading mechanism, then line 39 is coupled to another style of unloading mechanism such as, for example, a solenoid valve. By electrically tying the solenoid valve to the compressor, this valve is opened to the atmosphere thereby unloading line 39 whenever the compressor shuts off. This is true when tank 24 is filled as well as when power is interrupted such that the compressor is able to be restarted after a power failure. It is also envisioned to incorporate a relay with a time delay for the operate cycle as part of such a solenoid valve arrangement in order to provide desired delays between compressor and solenoid valve energizing.

Figure 6:
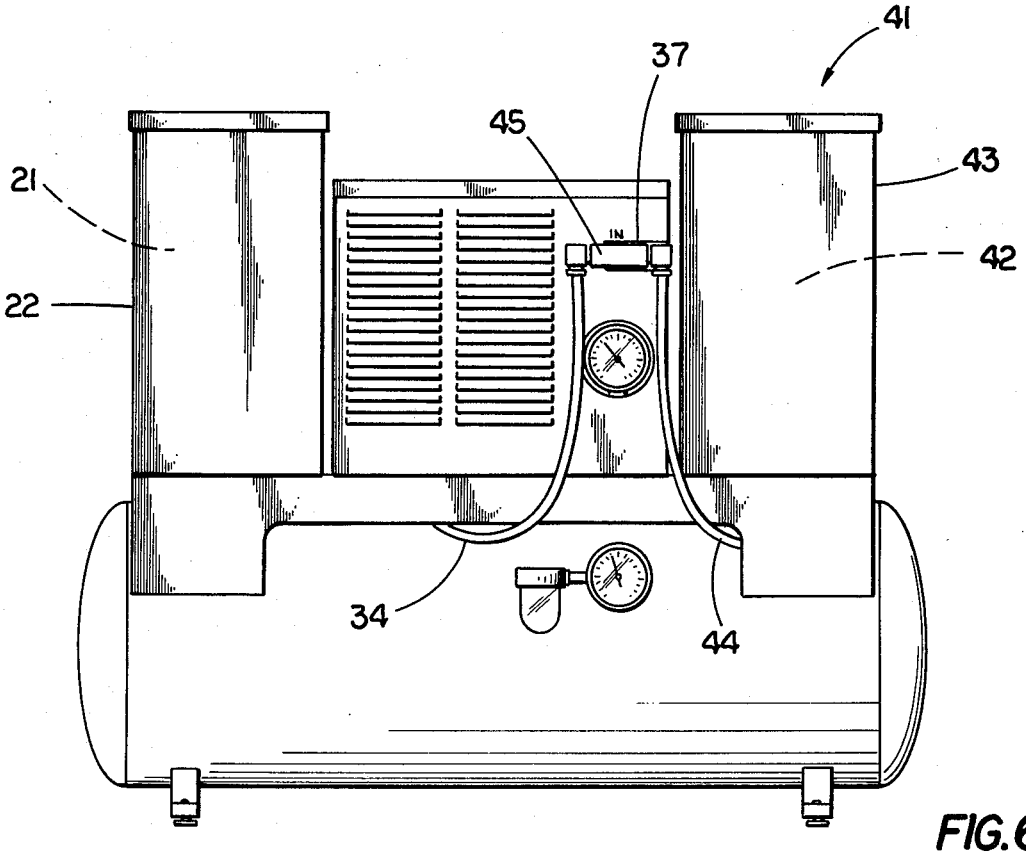
FIG. 6 is a front elevation view of an alternative of the FIG. 1 air compressor apparatus.

In certain applications, the demand for compressed air may be so frequent that there is insufficient time for the volume within reservoir tank 24 to be resupplied by the air compressor and refrigerant dryer combination before another demand cycle occurs. In these circumstances, it is possible to adapt the disclosed air compressor apparatus to an alternate configuration wherein two air compressors as well as two noise-reducing enclosures are included. Alternative air compressor apparatus 41 is illustrated in FIG. 6 and includes a first air compressor 21 within a first noise-reducing enclosure 22 as previously described. This alternative apparatus also includes a second air compressor 42 within a second noise-reducing enclosure 43. While air compressor 21 still couples to the inlet port 37 of refrigerant dryer 23 by means of outlet tube 34, second air compressor 42 similarly couples to inlet port 37 by its own outlet tube 44. In order to adapt refrigerant dryer 23 to this dual suply line arrangement, inlet port 37 is provided with a Tee-fitting 45. Although this alternative air compressor apparatus 41 has been described as desirable when the cycle time between demand periods is so rapid that there is not adequate time to recharge the reservoir tank 24, this arragement is also desirable when one of the two air compressors is provided as a backup unit to the other so that the operator can be assured of virtually continuous operation in the event one of the two air compressors would fail or otherwise malfunction. Regardless of which air compressor apparatus arrangement is utilized, an important aspect of each is the providing of a noise-reducing enclosure such as enclosure 22 for apparatus 20 and enclosure 43 for apparatus 41.

Figure 3:
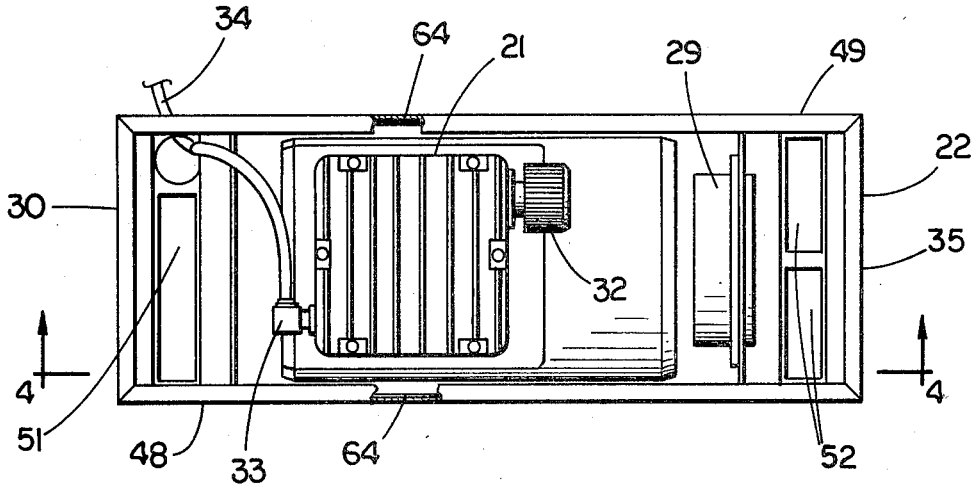
FIG. 3 is a fragmentary plan view of an air compressor and noise-reducing enclosure comprising a portion of the FIG. 1 air compressor apparatus.
Figure 4:
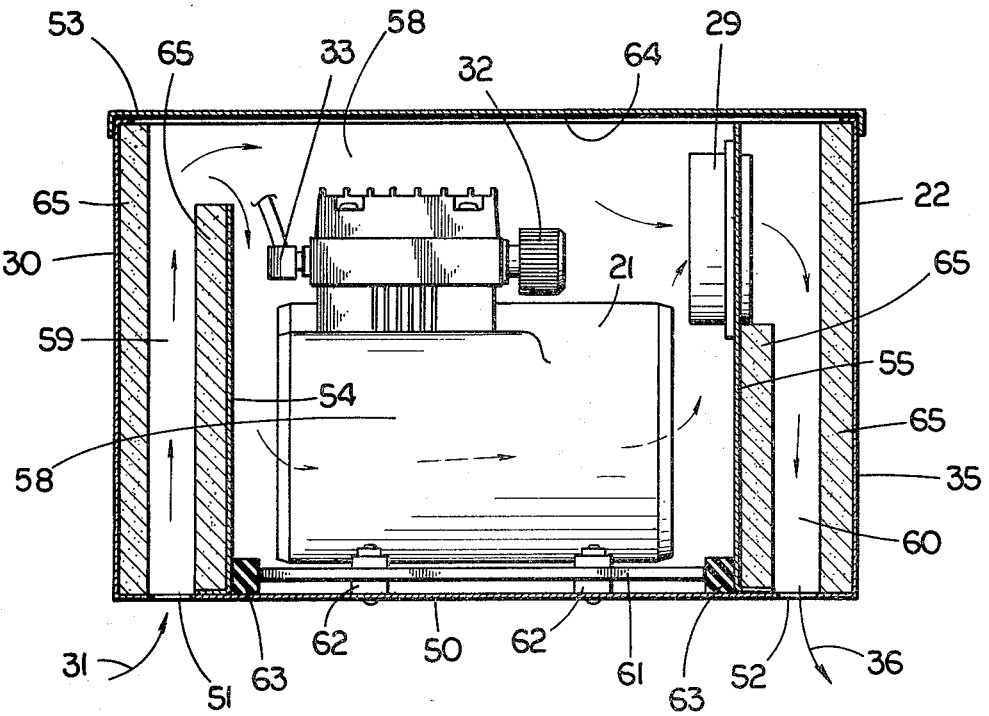
FIG. 4 is a front elevation view in full section as taken along line 4—4 in FIG. 3.
Figure 5:
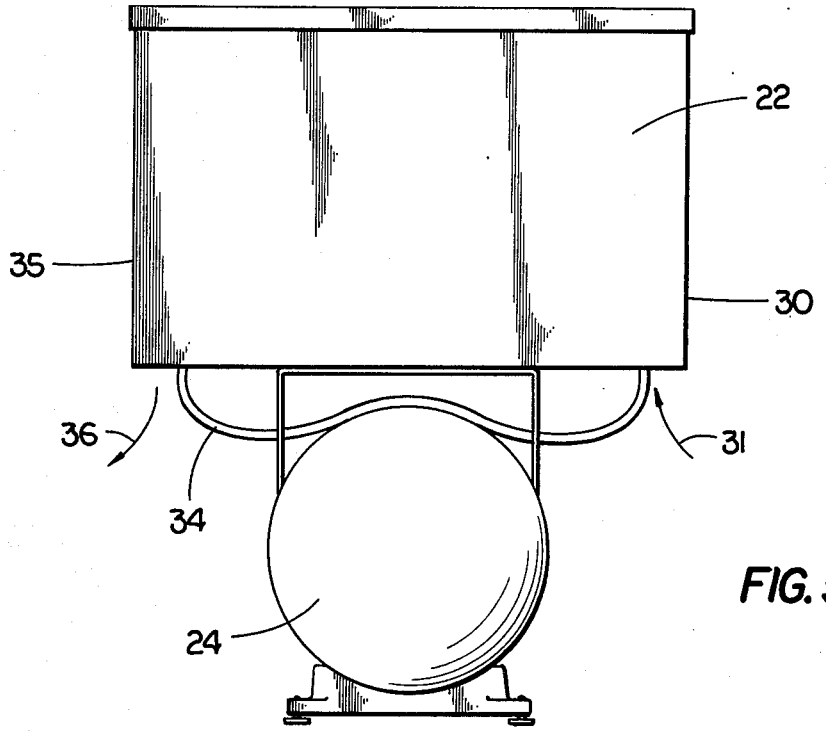
FIG. 5 is an end elevation view of the FIG. 1 air compressor apparatus.

Referring then to FIGS. 3 and 4, noise-reducing enclosure 22 is illustrated in greater detail and it is to be understood that the description which follows for this enclosure is virtually identical to the description of enclosure 43. In order to detail the interior construction of enclosure 22, the drawing orientation of FIGS. 3 and 4 is the result of a ninety-degree clockwise rotation from the orientation of enclosure 22 in FIG. 1. Enclosure 22 includes a first end 30 in the form of a vertical wall, a second and opposite end 35, also a vertical wall, inner wall 48 and outer wall 49. These four vertical wall members are arranged to enclose air compressor 21 and are joined to bottom surface 50 which is solid throughout with the exception of inlet aperture 51 at one end and outlet aperture 52 at the opposite end. Lid member 53 completes the outer construction of noise-reducing enclosure 22 thereby providing a somewhat sealed unit such that virtually the entire suction force of fan 29 acts to draw ambient air in through inlet aperture 51 and the portion of this air which is not utilized by air compressor 21 is thereafter expelled through outlet aperture 52. Intermediate ends 30 and 35 are internal baffle plates 54 and 55 which are disposed in a substantially parallel orientation relative to each other as well as relative to ends 30 and 35.

Internal baffle plates 54 and 55 in combination with bottom surface 50, inner wall 48 and outer wall 49 define an air compressor chamber 58 in which the air compressor 21 is positioned. Similarly, end 30 and internal baffle plate 54 in combination with these same enclosure outer surfaces define an air inlet chamber 59 which is open to the atmosphere at one end by means of inlet aperture 51 and is in communication with the air compressor chamber 58 adjacent its opposite end. Finally, end 35 in combination with internal baffle plate 55 as well as the enclosure outer surfaces previously mentioned define an air outlet chamber 60 which is open to the atmosphere at one end by way of outlet aperture 52 and is also in communication with the air compressor chamber 58 adjacent its opposite end. It should be noted that the communication between air outlet chamber 60 and air compressor chamber 58 is through fan 29 since internal baffle plate 55 extends completely from bottom surface 50 to lid member 53 and because fan 29 is mounted to internal baffle plate 55. The flow of air generated by fan 29 which passes through air inlet chamber 59 across air compressor 21 and out air outlet chamber 60 serves two purposes. The first purpose served is to provide a flow of air to air filter 32 for the operation of air compressor 21 and the second purpose is to provide a flow of cooling air so as to extract heat which is generated by the air compressor away from the air compressor. This heat removal allows the interior temperature of enclosure 22 to remain within an operably safe range for air compressor 21 and thereby avoids overheating of the air compressor. To accomplish these results, it is important that the volume capacity of fan 29 be rated at significantly higher rate than the requirements of air compressor 21 such that only a slight portion of the total incoming air is actually utilized by the air compressor and a majority of the incoming air is available for cooling purposes by means of forced convection. While this arrangement maintains the air compressor at a safe temperature level, another primary concern is how to reduce the level of generated noise which reaches the surrounding environment. Since enclosure 22 must be open at at least two points to permit the requisite air flow, these openings provide a path for internal noise (sound waves) to escape to the surrounding environment.

There are two primary sources of noise within air compressor apparatus 20. The first source of noise is from the operation of air compressor 21 by means of its internal components and operation. The second source of noise is due to vibrations inherent with any air compressor and which are transmitted to the surrounding enclosure causing the various walls and surfaces to vibrate. By suitably isolating air compressor 21 from enclosure 22, this transmitted vibration can virtually be eliminated. This isolation is accomplished by first mounting air compressor 21 onto a steel plate 61 and then insulating plate 61 from bottom surface 50 by means of four shock absorbers 62 disposed in line beneath the four mounting locations of compressor 21 to plate 61. While a variety of materials are available for such shock absorbers, it is important that the selected material sufficiently dampen any generated vibration by air compresor 21 such that these vibrations will not be transmitted to enclosure 22. Further shock absorbing is accomplished by means of shock absorbers 63 which are disposed on the edges of steel plate 61 between internal baffle plates 54 and 55 and the material used for shock absorbers 63 may be the same as that used for shock absorbers 62. From a size as well as structural configuration point of view, inner wall 48, outer wall 49 and lid member 53 represent large metal surface areas which are susceptible to noise generation due to an "oil-canning" concept. Their lack of inner structural supports or stiffening members accents vibration noises. Therefore, in order to reduce any potential noise generation by these metal surfaces, such as that resulting from any minor vibrations which could be transmitted from air compressor 21 to enclosure 22, these three surfaces are fitted with an adhesive-backed sound-deadening material 64 which is centrally positioned onto the interiorly-facing side of these three surfaces. This particular combination of shock absorbers and sound-deadening material virtually precludes any vibration noises associated with air compressor 21 from reaching the surrounding environment.

The next source of noise is sound waves generated by the air compressor itself and as previously mentioned, since enclosure 22 must be opened at two locations in order to provide a flow of circulating air, these openings, apertures 51 and 52, provide an escape path for these sound waves. These sound waves initially radiate in virtually all directions, however, they continue to bounce off of the solid, sound-reflective surfaces interior of enclosure 22 until such time as they find their way into air inlet chamber 59 and air outlet chamber 60. These chambers are specially designed with a clearance path of a particular dimension and the walls are lined with a thickness of acoustical foam 65. As the generated sound waves enter the top of each chamber on their path to the atmosphere via apertures 51 and 52, respectively, these sound waves bounce back and forth between the two layers of acoustical foam lining each chamber and each impact of the sound waves with such foam reduces a portion of the overall sound wave volume such that by the time the sound waves reach apertures 51 and 52, and the entire sound content has been virtually absorbed by this acoustical foam. An important aspect of this sound dampening arrangement is that the clearance space between the facing layers of acoustical foam is sized to a certain width (thickness) which corresponds to the particular wave length of the generated air compressor sound thereby maximizing the sound absorption by the acoustical foam. In the preferred embodiment, the width of the clearance zone between facing foam layers within each chamber is approximately one inch. This particular dimension has been scientifically arrived at by means of extensive sound analysis and testing conducted with respect to air compressor apparatus 20 utilizing a one-quarter horsepower air compressor. The resultant noise level of the apparatus tested was approximately equivalent to the sound level of a general typing office area with an average dBA of 60.

A further feature of air compressor apparatus 20 which is inherent within its operation is that the compressor fan which is prepackaged as part of air compressor 21 acts to create air turbulence inside of enclosure 22 and this further assists in reducing the heat in the compressor and circulating the air around the air compressor so that the air flow across the compressor head is able to maximize convection and maximize heat reduction of the internal atmosphere. Similarly, another feature which facilitates the noise reduction is that inlet aperture 51 is generally rectangular in shape and outlet aperture 52 comprises two generally rectangular-shaped openings. These particular aperture shapes have also been arrive at scientifically.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An air compressor apparatus including noise-reducing means for converting ambient air into compressed air, said air compressor apparatus comprising:

an air compressor having an inlet for ambient air and an outlet for compressed air; and a noise-reducing enclosure surrounding said air compressor and comprising:

four side walls, a bottom surface, and an enclosing top lid member;

two baffle plates cooperatively arranged relative to said four side walls and said bottom surface to define an air compressor chamber wherein said air compressor is positioned, an air inlet chamber and an air outlet chamber, said air inlet chamber being open to the atmosphere through said bottom surface at a first lower end of said air inlet chamber and in communication with said air compressor chamber at a second upper end which is adjacent said top lid member, said air outlet chamber being open to the atmosphere through said bottom surface at a first lower end of said air outlet chamber and in communication with said air compressor chamber at a second upper end which is adjacent said top lid member, said inlet chamber and said outlet chamber being on opposite sides of said air compressor chamber and said second upper ends establishing a direct air flow path across the top of said air compressor chamber; and a fan member disposed in said direct air flow path adjacent the second upper end of said air outlet chamber and above the corresponding baffle plate for drawing air from said air inlet chamber and through said air compressor chamber for forced convection.

2. The air compressor apparatus of claim 1 wherein internal portions of said air inlet chamber and of said air outlet chamber are lined with acoustical foam.

3. The air compressor apparatus of claim 2 which further includes a refrigerant dryer having an outlet and having an inlet in communication with the outlet of said air compressor and further including a reservoir tank having an inlet in communication with the outlet of said refrigerant dryer.

4. The air compressor apparatus of claim 3 which further includes an air compressor mounting plate secured to said air compressor and a plurality of shock-absorbing supports positioned between said mounting plate and said bottom surface and between said mounting plate and said air inlet and said air outlet chambers.

5. The air compressor apparatus of claim 3 which further includes pressure unloading means for pressure trapped between said air compressor and said reservoir tank.

6. The air compressor apparatus of claim 3 which further includes a second air compressor disposed within a second noise-reducing enclosure, said second air compressor having an outlet for compressed air coupled to the inlet of said refrigerant dryer.

7. A noise-reducing enclosure for packaging air compressors and similar devices which comprises:

a front wall, a rear wall, two opposite side walls and a bottom surface defining an interior open region;

a top lid member of suitable size and construction to close the top of said interior open region;

two interior baffle plates joined to said bottom surface and arranged so as to divide the entire interior open region into only three chambers, including an air inlet chamber at one end, an air outlet chamber at the opposite end and an air compressor chamber therebetween, said air inlet chamber being in flow communication with an inlet aperture open to the atmosphere and disposed in said bottom surface and having a flow exit adjacent said top lid member, said air outlet chamber having a flow entrance adjacent said top lid member and is in flow communication with an exit aperture open to the atmosphere and disposed in said bottom surface, said flow exit and said flow entrance defining an air flow path across the top portion of said air compressor chamber; and air circulation means disposed in said air flow path adjacent said flow entrance and above the corresponding baffle plate for drawing air from said air inlet chamber and through said air compressor chamber.

8. The noise-reducing enclosure of claim 7 which further includes air transfer means disposed within the interior baffle plate which defines one side of the air outlet chamber for circulating a forced flow of air up through said air inlet chamber across said air compressor chamber and down through said air outlet chamber.

9. The noise-reducing enclosure of claim 8 which further includes a plurality of acoustical foam sections secured to inner facing side surfaces of said air inlet chamber and of said air outlet chamber, and further including noise and vibration-dampening material applied to said front wall, said rear wall and said top lid member.

10. The noise-reducing enclosure of claim 9 wherein the thickness of said air inlet chamber and of said air outlet chamber between facing sections of said acoustical foam is between 0.75 inches and 1.25 inches.

11. An air compressor apparatus including noise-reducing means for converting ambient air into compressed air, said air compressor apparatus comprising:

an air compressor having an inlet for ambient air and an outlet for compressed air; and a noise-reducing enclosure surrounding said air compressor and comprising:

an air compressor chamber wherein said air compressor is positioned, said air compressor chamber having a lower portion for receipt of said air compressor and an upper open portion thereabove;

an air inlet chamber located adjacent one end of said air compressor chamber and having an inlet aperture open to the atmosphere at its lowermost end and a first flow communication aperture adjacent its uppermost end for flow communication with the interior of said air compressor chamber;

an air outlet chamber located adjacent the other opposite end of said air compressor chamber and having an outlet aperture open to the atmosphere at its lowermost end and a second flow communication aperture adjacent its uppermost end for flow communication with the interior of said air compressor chamber, said first and second flow communication apertures in said uppermost ends creating a direct air flow path from inlet aperture to outlet aperture which passes through said upper open portion of said air compressor chamber above said air compressor; and fan means disposed in said direct air flow path between said air compressor chamber and said air outlet chamber for drawing air out of said air compressor chamber.

* * * * *